US010052511B2

(12) United States Patent
Brown

(10) Patent No.: US 10,052,511 B2
(45) Date of Patent: Aug. 21, 2018

(54) TRICEPS DIP EXERCISE STAND

(71) Applicant: Isaiah Brown, Sturgis, MI (US)

(72) Inventor: Isaiah Brown, Sturgis, MI (US)

( * ) Notice: Subject to any disclaimer, the term of this patent is extended or adjusted under 35 U.S.C. 154(b) by 123 days.

(21) Appl. No.: 14/948,757

(22) Filed: Nov. 23, 2015

(65) Prior Publication Data

US 2017/0144008 A1 May 25, 2017

(51) Int. Cl.
*A63B 21/068* (2006.01)
*A63B 21/00* (2006.01)
*A63B 23/035* (2006.01)

(52) U.S. Cl.
CPC .. *A63B 21/00047* (2013.01); *A63B 23/03516* (2013.01)

(58) Field of Classification Search
CPC ..... A63B 23/1227; A63B 21/068
See application file for complete search history.

(56) References Cited

U.S. PATENT DOCUMENTS 248,121 A * 10/1881 Tuttle ..... A63B 21/0615 482/96
4,846,458 A * 7/1989 Potts ..... A63B 21/00181 482/113
5,961,430 A * 10/1999 Zuckerman ..... A63B 21/00047 482/141
2015/0065321 A1* 3/2015 Goodson ..... A63B 21/00047 482/142

* cited by examiner

*Primary Examiner* — Loan H Thanh
*Assistant Examiner* — Rae Fischer
(74) *Attorney, Agent, or Firm* — Gardner, Linn, Burkhart & Ondersma LLP

(57) ABSTRACT

A triceps dip exercise stand is provided for exercising a user's upper body and core. The stand includes a base, a vertical adjustment mechanism coupled to the base, a lateral adjustment mechanism coupled to a top portion of the vertical adjustment mechanism, and a pair of adjustable handgrips coupled to the lateral adjustment mechanism. The lateral adjustment mechanism adjusts the lateral position of each handgrip, and the vertical adjustment mechanism adjusts the vertical position of the handgrips. Each of the upright and lateral adjustment mechanisms are secured in respective positions using individual locking pins.

20 Claims, 3 Drawing Sheets

TRICEPS DIP EXERCISE STAND

FIELD OF THE INVENTION

The present invention is generally directed to personal workout equipment for physical fitness and, more particularly, to core and upper body stationary exercise equipment.

BACKGROUND OF THE INVENTION

Particular movements intended to exercise a user's core and upper body can be cumbersome, ineffective, and unsafe when performed incorrectly. Many factors affect how users perform an exercise, such as the user's fitness, skill and familiarity with the movement, size, and equipment involved. These factors individually and collectively influence the user's stability, effectiveness, and comfort during the exercise. Thus, improving each of these factors will affect the user's stability, effectiveness, and comfort during core and upper body exercises.

SUMMARY OF THE INVENTION

The present invention provides a triceps dip exercise stand for stably and effectively exercising. The triceps dip exercise stand is configured so that the user can perform many exercises stably, effectively, and comfortably, regardless of their physical characteristics or fitness level, and for various exercise movements. The user may perform triceps dips that exercise many muscles in the arms, shoulders, back, and neck by gripping handgrips with forearms vertical and perpendicular to the upper stem while bending the elbows and shoulders. The user may also perform leg raises that exercise many muscles in the legs and core by gripping the handgrips and placing the forearms on and parallel to the upper stem and raising the legs.

According to an aspect of the present invention, a triceps dip exercise stand includes a base, a lateral adjustment mechanism, and a vertical adjustment mechanism coupled to the base. The lateral adjustment mechanism includes adjustable handgrips so the user can stably and effectively perform exercises. Each of the adjustable handgrips has one upper stem and a lower stem to support the user gripping the handgrips. The lateral adjustment mechanism is joined to a top portion of the vertical adjustment mechanism that is configured to adjust the vertical position of the handgrips. The vertical adjustment mechanism is coupled to the base that provides a foundation for the stand and secures the stand while the user is performing exercises.

In one form, either or both of the lateral adjustment mechanism and the vertical adjustment mechanism are secured with individual locking pins.

Optionally, the stand may include items such as padding and textured grips to increase the user's comfort and stability, and fasteners that secure the stand and the adjustment mechanisms while exercising.

Thus, the triceps dip exercise stand of the present invention provides an apparatus that is adaptable for users having different body geometries to effectively and securely perform upper body and core exercises by first adjusting the lateral and vertical positions of the handgrips. The stand may also include additional items to increase the user's comfort and stability of the dip stand while exercising.

These and other objects, advantages, purposes and features of this invention will become apparent upon review of the following specification in conjunction with the drawings.

DESCRIPTION OF THE PREFERRED EMBODIMENTS

Figure 1:
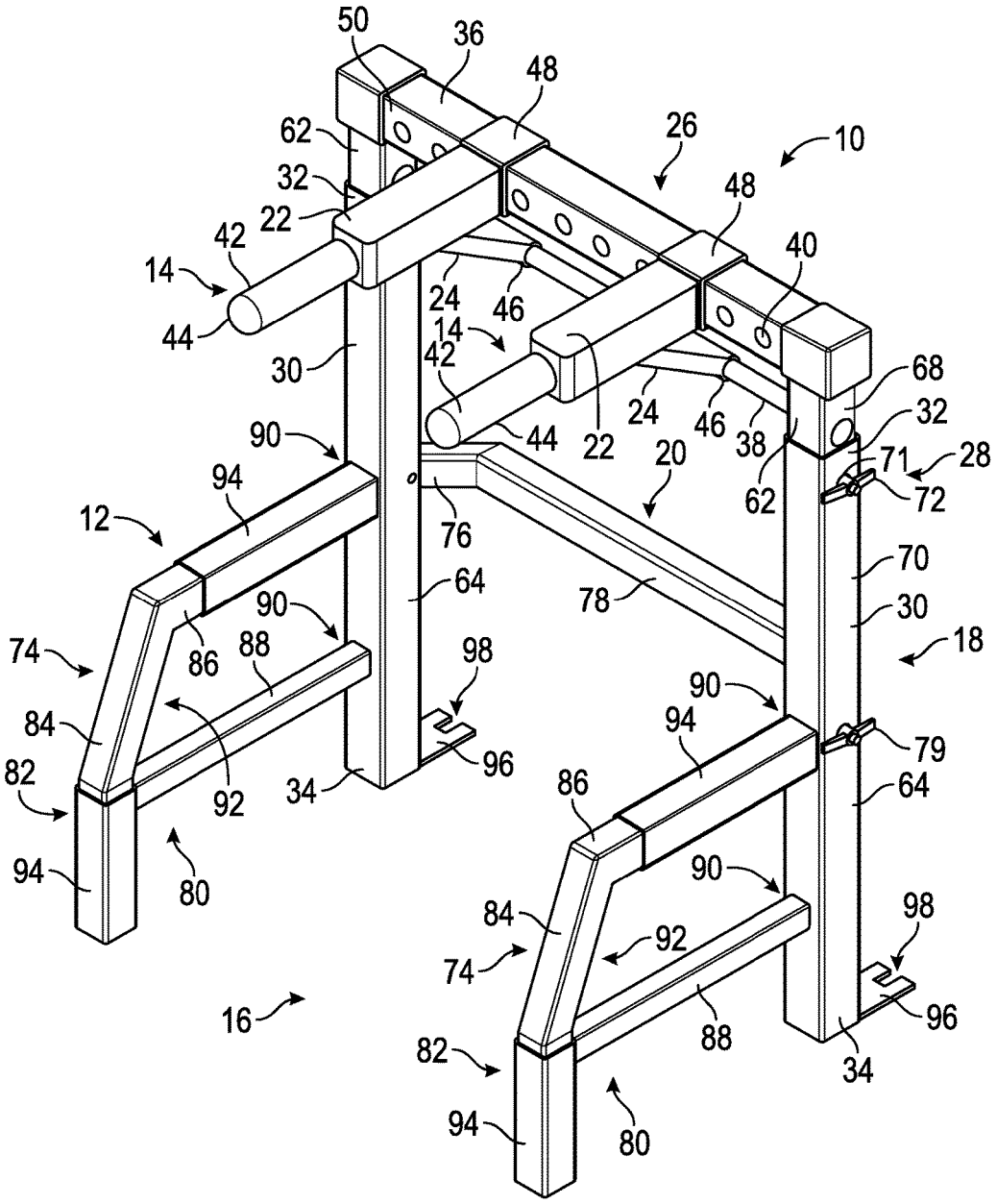
FIG. 1 is a front perspective view of a triceps dip exercise stand in accordance with the present invention.

Referring now to the drawings and the illustrative embodiments therein, a triceps dip exercise stand 10 is an apparatus for stably and effectively exercising that includes a base 12 and a pair of adjustable handgrips 14, as shown in FIGS. 1-6. Each handgrip 14 is manually adjustable vertically and horizontally relative to the base 12. A user adjusts each handgrip 14 horizontally using a lateral adjustment mechanism 26 and vertically using a vertical or upright adjustment mechanism 28 to comfortably and stably perform triceps dips and other exercise motions based on the user's size and preference. The user's size generally refers to their physical characteristics, such as height, arm span, weight, and the like. The position of each handgrip 14 is also determined by the preferred target muscles for the particular exercise, such as the triceps or abdomen, etc. The stand 10 (FIG. 1) allows the user to enter through an open front portion 16 between the protruding handgrips 14 and opposite a rear portion 18 having a stability support member 20, and adjust each handgrip 14 vertically and horizontally to comfortably and stably perform exercises.

Each of the adjustable handgrips 14 has an upper stem 22 and a lower stem 24 that couple to a lateral adjustment mechanism 26, as shown in FIGS. 1, 2, and 4-6. The lateral adjustment mechanism 26 is fixed to a pair of uprights 30 of the vertical adjustment mechanism 28, which is coupled to the base 12. Each of the uprights 30 extends from a top portion 32 that is coupled to the lateral adjustment mechanism 26 to the base 12 at a bottom portion 34.

The lateral adjustment mechanism 26 includes a pair of horizontal parallel cross-members 36, 38. Specifically, the lateral adjustment mechanism 26 includes an upper cross-member 36 and a horizontal support or lower cross-member 38. Optionally, at least one of the cross-members (such as lower cross-member 38) has a circular cross-section to allow the hand grips to rotate about the cross-member having a circular cross-section while adjusting the position of the handgrips 14. The other cross-member, such as the upper cross-member 36 of the illustrated embodiment, may have one of many cross-sectional shapes, including circular, triangular, square, etc. Furthermore, the upper cross-member 36 has a set of apertures 40 facing the front portion 16 and between each upright 30 of the vertical adjustment mechanism 28, which facilitate adjustment and secure the lateral positions of the handgrips 14, as will be described in more detail below. Each cross-member 36, 38 of the lateral adjustment mechanism 26 is fixed to each upright 30 by welding or fasteners, such as bolts, rivets, or the like. Fasteners allow the user to disassemble the stand when desired, such as for shipping or storage.

Figure 2:
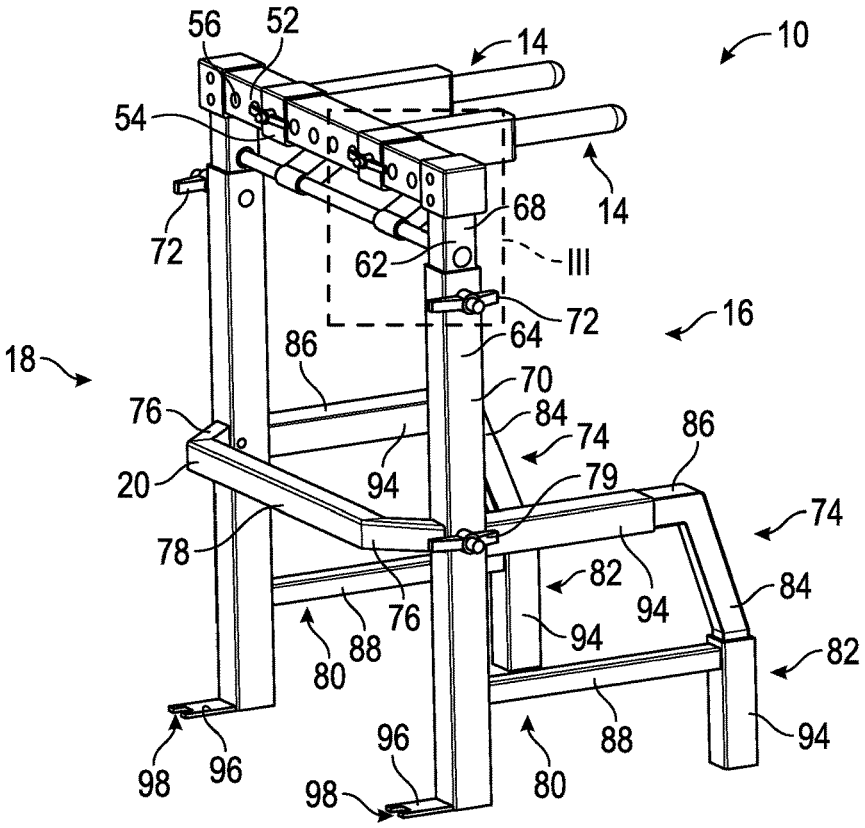
FIG. 2 is a rear perspective view of the triceps dip exercise stand of FIG. 1.
Figure 3:
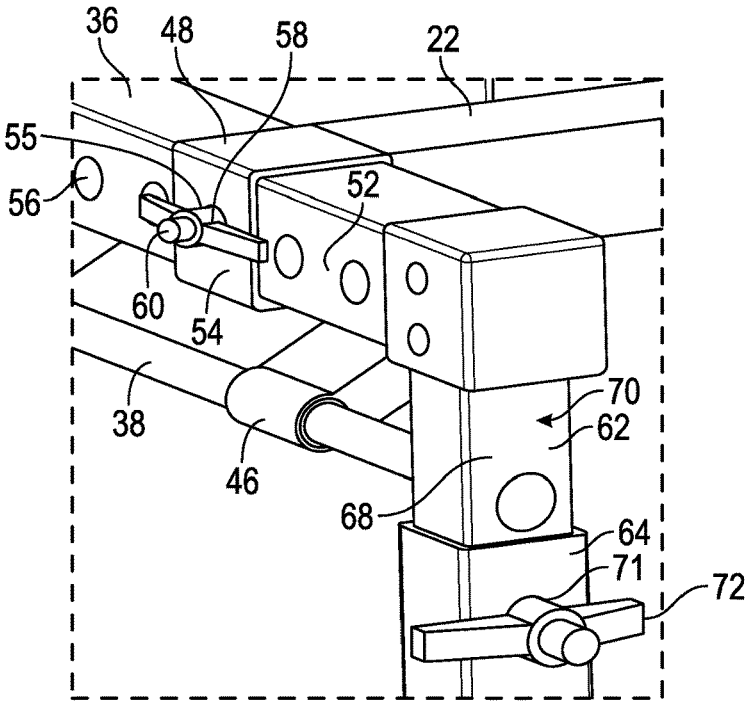
FIG. 3 is an enlarged view of the area designated III in FIG. 2.
Figure 4:
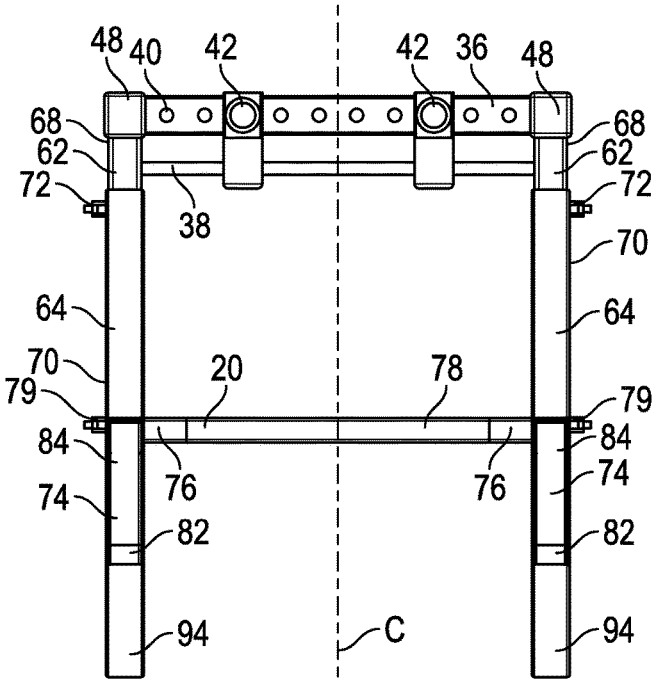
FIG. 4 is a front elevation of the triceps dip exercise stand of FIG. 1.

Each lower stem 24 of each handgrip 14 is slidably coupled to the lower cross-member 38, as shown in FIGS. 1-3. In the illustrated embodiment, a lower coupling portion 46 of each of the lower stems 24 slidably couples to the lower cross-member 38. An upper coupling portion 48 of each upper stem 22 slidably couples with the upper cross-member 36 of the lateral adjustment mechanism 26. Thus, each of the handgrips 14 is independently slidable on or along the lower cross-member 38 and upper cross-member 36. The upper coupling portions 48 are configured to partially surround the upper cross-member 36 to ensure that each handgrip 14 securely supports the user during exercises. In the illustrated embodiment, the upper coupling portions 48 have square cross-sections that surround all sides of the upper cross-member 36 including a front-facing portion 50 and a rear face 52 of the upper cross-member 36 (FIGS. 1-3). During exercises, the user's weight is generally supported by the grip portions 42, lower stems 24, and lower cross-member 38. The upper stems 22 and upper cross-member 36 also support the user's weight, and resist rotation of the handgrips 14 about the lower cross-member 38 due to the moment arm between the user's center of mass and the cross-members 36, 38.

A rear-facing portion 54 of each upper coupling portion 48 (FIG. 3) has an aperture 55, and the rear face 52 of the upper cross-member 36 has the plurality of apertures 56 spaced between each upright 30 that are configured to selectively align with the aperture 55 of the upper coupling portion 48 to receive the locking pin 58. Thus, one locking pin 58 through each of the apertures 55 of the upper coupling portions 48 and the respective aligned apertures 56 of the upper cross-member 36 secures the lateral positions of the handgrips 14 to the lateral adjustment mechanism 26. Referring to FIGS. 2 and 3, the user manually adjusts the lateral position of one handgrip 14 by pressing and holding a releasing button 60 on a locking pin 58 to unlock the pin 58 from the stand, then pulling the unlocked pin 58 from respective apertures 40, 56 of the upper cross-member 36 and from the upper coupling portion 48. The user then slides the unlocked handgrip 14 along the upper cross-member 36 and lower cross-member 38 to align the aperture 55 of the coupling portion 48 with the selected upper cross-member apertures 40, 56. The user inserts the pin 58 into the aligned apertures 40, 56 and releases the button 60 to secure the handgrip 14 in the preferred lateral position. The user may adjust the lateral position of each handgrip 14 individually and independently from the other handgrip 14, or the user may adjust both handgrips 14 simultaneously.

The preferred lateral position of each handgrip 14 on the stand 10 generally depends on the size of the user, such as shoulder width and arm span, and the desired exercise. However, many users will perform most exercises with their center of mass along a central vertical plane C of the dip stand 10 (FIG. 4) that substantially bisects the lateral adjustment mechanism 26. Thus, users will generally position each handgrip 14 on opposing sides of the central plane C and substantially equidistant from the central plane C.

Grip portions 42 and upper stems 22 provide surfaces for the user to engage and be supported by the dip stand 10, depending on the desired exercise. For example, the user may perform triceps dips by gripping the handgrips 14 and having their forearms vertical and perpendicular to the upper stem 22 while bending their elbows and shoulders. The user may also perform leg raises by gripping the grip portions 42 and resting their forearms on and parallel to the upper stem 22. The dip stand 10 may also include padding surrounding the upper stems 22 to protect users from injury and provide comfort for certain exercises. The padding may be foam, rubber, or the like, and may be attached to the upper stems 22 by hook-and-loop fasteners, zippers, buttons, or the like.

Grip portions 42 are provided at the end of the handgrips 14, opposite the cross-members 36, 38, and are shaped for the user to grip tightly and press their weight into the handgrip 14 without discomfort. Each grip portion 42 is cantilevered from the upper stem 22, and has a circular cross-section (FIGS. 4-6) and a length that allows the user to re-position their hand on the grip portion 42. Each grip portion 42 is also configured for the user's hands to grip tightly without slipping or rotating, particularly when the user is perspiring. Optionally, and as shown in the illustrated embodiment, the grip portion 42 has a grip cover 44 that has a size and shape similar to the grip portion 42 to frictionally fit over the grip portion 42, the grip cover 44 having a generally hemispherical tip (FIGS. 1, 2, 5 and 6), or optionally having a planar or conical tip. The grip cover 44 may provide a texture or adhesive surface for the user to grip. The grip portion 42 may also have a textured surface, such as a knurled or crosshatched surface or the like, such as to facilitate the user gripping the grip portion 42 directly, or to more securely attach the grip covers 44 to the grip portions 42.

Figure 5:
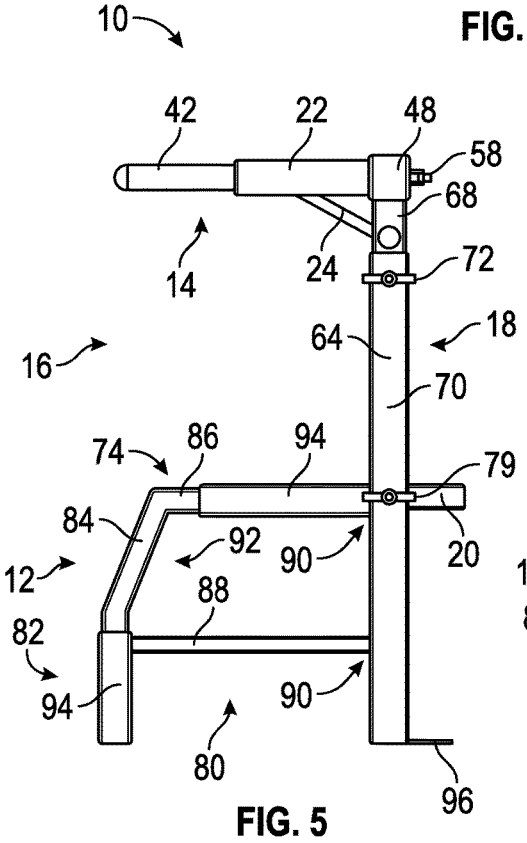
FIG. 5 is a left side elevation of the triceps dip exercise stand of FIG. 1 with the inner uprights lowered.
Figure 6:
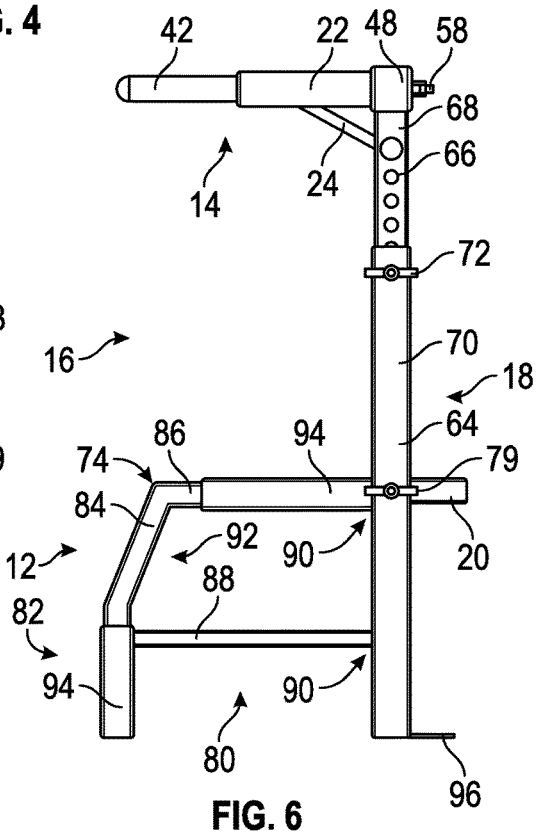
FIG. 6 is a left side elevation of the triceps dip exercise stand of FIG. 1 with the inner uprights extended.

Each upright 30 has an extendable and retractable inner upright 62 and a fixed outer upright 64. The inner upright 62 is a movable portion of said upright 30 that is configured to be slidably displaced by the user into and out of the outer upright 64 in a telescoping manner to adjust the height of the handgrips 14 (FIGS. 5 and 6). Each inner upright 62 has a similar cross-section as the outer upright 64. The cross-sections of the inner uprights 62 and outer uprights 64 of the illustrated embodiment are square, although other shapes may be used, such as rectangular, triangular, circular, or the like. Each inner upright 62 has a set of apertures 66 (FIG. 6) spaced along an outside face 68 thereof, and each outer upright 64 has an aperture 71 on an outside face 70 thereof. Thus, the apertures 66 of the inner uprights 62 and the apertures 71 of the outer uprights 64 selectively align as the user adjusts the inner uprights 62 vertically upward and downward within the respective outer uprights 64.

To secure the vertical adjustment mechanism 28 at a selected height, the user inserts a locking pin 72 into each of the aligned apertures 66, 71 of the inner uprights 62 and outer uprights 64, respectively. The user adjusts the height of the handgrips 14 (and the entire linear adjustment mechanism 26) by removing each locking pin 72 from each upright 30, lowering or raising the lateral adjustment mechanism 26 with respect to the base 12 by displacing the inner uprights 62 within the respective outer uprights 64 to a desired height, and inserting the locking pins 72 through the aligned apertures 66 of each inner upright 62 and the aperture 71 of the corresponding outer upright 64. The locking pin 72 is similar (and may be identical) to the pin 58 used for securing the lateral positions of the handgrips 14, as described above.

Referring to FIGS. 1, 2, and 4-6, the base 12 of the triceps dip stand 10 provides a stable foundation for the user to effectively exercise. The base 12 includes the stabilizing member 20 at rear portion 18, and a pair of stabilizing legs 74, and is further fixed to the outer upright members 64 by welding or other types of fastening. The stabilizing member 20 is configured to increase the rigidity of the triceps dip stand 10 so the stand is less likely to deform or shake while the user is exercising, yet not interfere with the user. The stabilizing member 20 extends horizontally between each of the outer upright members 64 and is located between the bottom portion 34 and open top portion 32 of each upright 30. The stabilizing member 20 extends in a segmented and pseudo-arcuate manner to form part of the rear portion 18. Specifically, the stabilizing member 20 has an angled member 76 that extends from each outer upright member 64 toward the stand's rear portion 18 at an oblique angle with respect to the central vertical plane C, and each angled member 76 is coupled to a central member 78 that is perpendicular to the vertical central plane C and substantially parallel to the floor. The stabilizing member 20 is removable to ease shipping and storage, and fixes to the outer upright members 64 by locking pins 79, which are generally similar to locking pins 58, 72 as described above. Thus, the stabilizing member 20 remains clear of open front portion 16 and adds rigidity to the triceps dip stand 10 while allowing the user to move freely within the open front portion 16.

The stabilizing legs 74 further provide a foundation for the dip stand 10 so the user can perform the exercises stably and effectively. Each leg 74 is coupled to each respective upright member 30 by fastening, welding, or the like, and forms part of the front portion 16 of dip stand 10, extending away from the stabilizing member 20. Each leg 74 couples to one or more point of each upright member 30 between the top portion 32 and bottom portion 34. Each leg 74 has a generally horizontal leg portion 80 and a generally upright leg portion 82. The upright leg portion 82 further includes a diagonal leg portion 84. In the illustrated embodiment, the horizontal leg portion 80 includes an upper leg bar 86 that is parallel to a lower leg bar 88. Each bar 86, 88 of each horizontal leg portion 80 couples to the upright member 30 at a first end 90 and couples to the upright leg portion 82 at a second end 92. Each of the horizontal leg portions 80 and upright leg portions 82 have a square cross-section, although it is envisioned that each horizontal leg portion 80 and each upright leg portion 82 may have other cross-sectional shapes, such as circular, I-shaped, or the like. The illustrated embodiment also includes padding 94 surrounding the horizontal leg portions 80 and upright leg portions 82 of the legs 74 to help protect users from injury. The padding 94 may be foam, rubber, or the like, and is attached to the horizontal leg portions 80 and upright leg portions 82 by hook-and-loop fasteners, zippers, buttons, or the like.

The base 12 of the triceps dip stand 10 also includes mount coupling members 96, best shown in FIGS. 1 and 2, configured to restrict movement of the dip stand 10 while the user is performing exercises. Each mount coupling member 96 is a flat planar section with a slot 98 that forms a U-like shape or an aperture, to receive a fastener so the user can tighten the fastener against the mount coupling member 96 and a support surface. The mount coupling members 96 shown in the illustrated embodiment extend from the bottom portions 34 of the uprights 30 toward the rear portion 18 of the dip stand 10. Thus, a fastener tightened in the slot 98 of each mount coupling member 96 to a support surface would restrict the triceps dip stand from rotating or shifting on the surface, or from lifting from the surface.

Therefore, the present invention provides an adjustable triceps dip exercise stand for stably and effectively exercising. The triceps dip stand is configured so that the user can perform many exercises stably, effectively, and comfortably, regardless of their physical characteristics or fitness level, and for various exercise movements. Users simultaneously adjust each handgrip vertically on a pair of uprights, and individually adjust each handgrip horizontally on horizontal cross-members, based on the user's size and preference to perform triceps dips and other exercise motions. The stand may also include items such as padding that increase the user's comfort and stability, and various fasteners that secure the stand and the adjustment mechanisms while exercising.

Changes and modifications in the specifically described embodiments can be carried out without departing from the principles of the present invention which is intended to be limited only by the scope of the appended claims, as interpreted according to the principles of patent law including the doctrine of equivalents.

The invention claimed is:

1. An exercise apparatus comprising:

a base;

a pair of uprights extending upwardly from said base, wherein the lengths of said uprights are adjustable;

a horizontal cross-member extending in a lateral direction between said uprights and having opposite end portions coupled to said uprights, respectively; and a set of adjustable handgrips coupled to said base via said horizontal cross-member and said uprights, said adjustable handgrips extending forwardly from said horizontal cross-member and spaced apart from one another in the lateral direction, wherein said handgrips are horizontally repositionable in the lateral direction along said horizontal cross-member;

wherein said handgrips are manually adjustable in a vertical direction by adjusting the lengths of said uprights.

2. The exercise apparatus of claim 1, wherein said handgrips are slidably coupled to said horizontal cross-member.

3. The exercise apparatus of claim 2, wherein said handgrips are selectively lockable to said horizontal cross-member.

4. The exercise apparatus of claim 3, further comprising:

a pair of removable pins; and a plurality of apertures spaced along said horizontal cross-member;

wherein each of said handgrips is selectively lockable at one of said apertures with one of said pins.

5. The exercise apparatus of claim 1, further comprising a horizontal support member extending laterally between said uprights and having opposite end portions coupled to said uprights, and a pair of lower stems extending from said horizontal support member to respective ones of said handgrips.

6. The exercise apparatus of claim 5, wherein each of said uprights comprises an inner upright member and an outer upright member coupled together in a telescoping manner to form a vertical adjustment mechanism, wherein said vertical adjustment mechanism is operable to adjust both the height of said horizontal support member and the height of said horizontal cross-member relative to said base.

7. The exercise apparatus of claim 6, wherein said vertical adjustment mechanism further comprises a locking pin selectively insertable through each of said inner upright members and corresponding ones of said outer upright members to fix said handgrips in a selected vertical position.

8. An exercise apparatus comprising:

a vertical adjustment mechanism having a top portion and a bottom portion, wherein said top portion is vertically adjustable relative to said bottom portion;

a lateral adjustment mechanism coupled to said top portion of said vertical adjustment mechanism;

a pair of upper stems and a corresponding pair of lower stems slidably coupled to said lateral adjustment mechanism and spaced laterally apart from one another, wherein said upper stems extend forwardly in a substantially horizontal direction and said lower stems extend diagonally rearwardly from respective ones of said upper stems;

a base coupled to said bottom portion of said vertical adjustment mechanism; and a set of handgrips coupled to respective ones of said upper and lower stems;

wherein said handgrips are vertically adjustable relative to said base via vertical adjustment of said top portion relative to said bottom portion and said handgrips are laterally adjustable toward or away from one another via operation of said upper and lower stems along said lateral adjustment mechanism.

9. The exercise apparatus of claim 8, wherein said handgrips are manually adjustable in the lateral direction.

10. The exercise apparatus of claim 9, said lateral adjustment mechanism further comprising a plurality of apertures, wherein said upper stems are repositionable at different ones of said apertures.

11. The exercise apparatus of claim 10, further comprising a pair of locking pins, wherein each of said handgrips is selectively and independently repositionable toward or away from the other of said handgrips by disengaging said locking pins from respective ones of said apertures.

12. The exercise apparatus of claim 10, wherein said lateral adjustment mechanism comprises an upper cross-member and a lower cross-member, and wherein said upper stem of each handgrip is coupled to said upper cross-member and said lower stem of each handgrip extends both rearwardly and downwardly and is coupled to said lower cross-member.

13. The exercise apparatus of claim 12, wherein said lower stem of each handgrip is slidably coupled to said lower cross-member and said upper stem of each handgrip is independently and selectively securable to said upper cross-member.

14. The exercise apparatus of claim 13, wherein said upper stem of each handgrip is selectively securable against sliding in the lateral direction relative to said upper cross-member by selectively inserting a locking pin into an aperture formed in said upper cross-member.

15. The exercise apparatus of claim 14, wherein a portion of said lower stem of each handgrip entirely surrounds at least a portion of said lower cross-member, and a portion of said upper stem of each handgrip entirely surrounds at least a portion of said upper cross-member.

16. The exercise apparatus of claim 15, wherein said upper cross-member comprises a plurality of said apertures in spaced arrangement.

17. The exercise apparatus of claim 8, wherein said top portion of said vertical adjustment mechanism is slidably repositionable and fixable by manually adjusting said top portion of said vertical adjustment mechanism and inserting a pin through both said top and bottom portions of said vertical adjustment mechanism.

18. The exercise apparatus of claim 8, wherein said vertical adjustment mechanism comprises a pair of inner uprights and a pair of outer uprights, wherein said inner uprights are coupled to said lateral adjustment mechanism, and said inner uprights are slidably disposed within said outer uprights.

19. The exercise apparatus of claim 18, wherein said vertical adjustment mechanism comprises a set of apertures disposed in each of said pair of inner uprights, an aperture disposed in each of said pair of outer uprights, and a pair of locking pins that are selectively receivable through said apertures of said inner uprights when said apertures of said inner uprights are aligned with said apertures of said outer uprights.

20. An exercise apparatus comprising:

a pair of outer uprights having respective open top portions and bottom portions, each of said outer uprights having an outer pin aperture at said top portion;

a base including at least said bottom portions of said outer uprights, a stabilizing member coupled to said outer uprights, and a pair of legs coupled to said outer uprights and extending forwardly relative to said stabilizing member, wherein said legs include generally horizontal leg portions extending horizontally forward to a front side of said apparatus, and generally upright leg portions extending vertically downward from corresponding ones of said horizontal leg portions;

wherein said stabilizing member is coupled to each of said outer uprights between said bottom portion and said open top portion, said stabilizing member extending toward a rear side of said apparatus and extending horizontally between said outer uprights;

a pair of inner uprights slidably disposed within said top portions of each of said outer uprights, wherein each of said inner uprights includes at least two inner upright member pin apertures in vertically-spaced arrangement, wherein said inner upright member pin apertures selectively align with said outer pin apertures of said outer uprights, and wherein each of said outer uprights includes a floor coupling member at said bottom portion;

a support cross-member and a horizontal cross-member in vertically spaced arrangement with said support cross-member positioned below said horizontal cross-member, said horizontal cross-member having a plurality of apertures in horizontal spaced arrangement, each of said support cross-member and said horizontal cross-member extending between and coupling said inner uprights together above said top portions of said outer uprights;

a pair of handgrips each having an upper stem extending forwardly from said horizontal cross-member, a lower stem extending rearwardly and downwardly away from said upper stem, and a grip portion extending forwardly from said upper stem, wherein each of said lower stems is slidably coupled to said support cross-member and each of said upper stems is slidably coupled to said horizontal cross-member to permit horizontal movement of said handgrips laterally toward or away from one another, wherein said upper stem at least partially surrounds said horizontal cross-member, and each upper stem has a pin aperture that selectively aligns with one of a plurality of pin apertures of said horizontal cross-member to receive a locking pin.

* * * * *